US008265322B2

(12) United States Patent
Uchida et al.

(10) Patent No.: US 8,265,322 B2
(45) Date of Patent: Sep. 11, 2012

(54) HEADPHONE

(75) Inventors: Hiroshi Uchida, Yokohama (JP); Takashi Sawada, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 126 days.

(21) Appl. No.: 12/928,288

(22) Filed: Dec. 8, 2010

(65) Prior Publication Data

US 2011/0142276 A1 Jun. 16, 2011

(30) Foreign Application Priority Data

Dec. 11, 2009 (JP) ..... 2009-281409

(51) Int. Cl.
*H04R 25/00* (2006.01)

(52) U.S. Cl. ..... 381/370; 381/371; 381/380

(58) Field of Classification Search ..... 381/309, 381/322, 324, 328, 72, 74, 370, 371, 372, 381/374, 376, 380, 382; 181/129, 130, 135; 379/430, 433.02; 128/864, 867
See application file for complete search history.

(56) References Cited

U.S. PATENT DOCUMENTS 4,736,435 A * 4/1988 Yokoyama et al. ..... 381/380
4,965,838 A * 10/1990 Kamon et al. ..... 381/380
5,887,070 A * 3/1999 Iseberg et al. ..... 381/380

FOREIGN PATENT DOCUMENTS

JP 2009-060207 3/2009

* cited by examiner

*Primary Examiner* — Huyen D Le
(74) *Attorney, Agent, or Firm* — Renner, Kenner, Greive, Bobak, Taylor & Weber

(57) ABSTRACT

A headphone has a speaker unit with a diaphragm and a driving source that vibrates the diaphragm along a driving axis that passes through the speaker unit. The speaker unit has a first face and an opposing second face along the driving axis. The diaphragm and the driving source are installed in the speaker unit between the first and second faces. First and second weighting members are fixed as being in contact with the first and second faces, respectively. The speaker unit and the weighting members are installed in a housing. At least either of the weighting members is fixed to the housing. The speaker unit is installed in the housing via the weighting members so that the speaker unit is not in direct contact with the housing. The weighting members have a higher specific gravity than the housing.

7 Claims, 6 Drawing Sheets

HEADPHONE

CROSS-REFERENCE TO RELATED APPLICATIONS

This application is based on and claims the benefit of priority from the prior Japanese Patent Application No. 2009-281409 filed on Dec. 11, 2009, the entire contents of which is incorporated herein by reference.

BACKGROUND OF THE INVENTION

The present invention relates to a headphone with high audio-signal conversion efficiency and sound quality.

The widespread of portable music players has recently made the market of headphones active.

The headphone is divided into several types, such as, an overhead type equipped with a headband and resting on the user's head and an inner-ear type to be fit in the antihelix of a user's ear.

A housing, the main body of a headphone, requires to be light weight because the headphone is rested on the user's head or fit in the antihelix of a user's ear. Thus, generally, the housing is produced by resin injection molding or light-metal processing. A resin material is used, especially, for low cost production.

Installed in the housing is a speaker unit that converts audio signals into sounds and outputs the sounds.

It is known that several problems occur when the installed speaker unit is in direct contact with a resin-made housing.

A problem is, for example, a big difference in sound quality depending on the types of resin material, the shape of housing, etc. even if headphones are equipped with the identical speaker units.

Another problem is lowered audio-signal conversion efficiency due to the attenuated energy of vibration in the housing without given off outwardly when transferred from the speaker unit. This is because resin exhibits low stiffness so that it can absorb the energy of vibration well, thus causing a high internal loss in transfer of vibration.

A technique to solve such problems is disclosed in Japanese Un-Examined Patent Publication No. 2009-60207 (referred to as a document 1, hereinafter) applied by the applicant of the present patent application.

Disclosed in the document 1 a headphone equipped with a speaker unit that is fixed to a fixing ring that is fixed to a housing so that the speaker unit is not in direct contact with the housing, the fixing ring having a higher specific gravity than the housing.

Especially, shown in (b) of FIG. 1 and also FIG. 3 of the document 1 are headphones each equipped with a speaker unit that is supported by a fixing ring at the rear and side faces of the speaker unit, the fixing ring having a higher specific gravity than a housing.

The headphones disclosed in the document 1 thus exhibit high audio-signal conversion efficiency and sound quality achieved with the fixing ring that receives the reaction of a diaphragm of the speaker unit in the opposite direction (the rear side) of a sound-emitting side (the front side) to which the diaphragm moves while vibrating.

Nevertheless, the headphones still have room for improvement in audio-signal conversion efficiency and sound quality because the fixing ring cannot receive the reaction of the diaphragm to the front side that is caused by the movement of the diaphragm to the rear side while vibrating.

SUMMARY OF THE INVENTION

A purpose of the present invention is to provide a headphone that exhibits higher audio-signal conversion efficiency and sound quality, irrespective of the movement of the diaphragm to the front and rear sides.

The present invention provides a headphone for converting an audio signal into a sound and outputting the sound comprising: a speaker unit including a diaphragm and a driving source that vibrates the diaphragm along a driving axis that passes through the speaker unit, the speaker unit having a first face and an opposing second face along the driving axis, the diaphragm and the driving source being installed in the speaker unit between the first and second faces; a first weighting member fixed as being in contact with the first face of the speaker unit; a second weighting member fixed as being in contact with the second face of the speaker unit; and a housing that installs the speaker unit and the first and second weighting members, wherein at least either the first or the second weighting member is fixed to the housing, the speaker unit is installed in the housing via the first and second weighting members so that the speaker unit is not in direct contact with the housing, and the first and second weighting members have a higher specific gravity than the housing.

DETAILED DESCRIPTION OF PREFERRED EMBODIMENT

A preferred embodiment according to the present invention will be described with reference to FIGS. 1 to 6.

Figure 1:
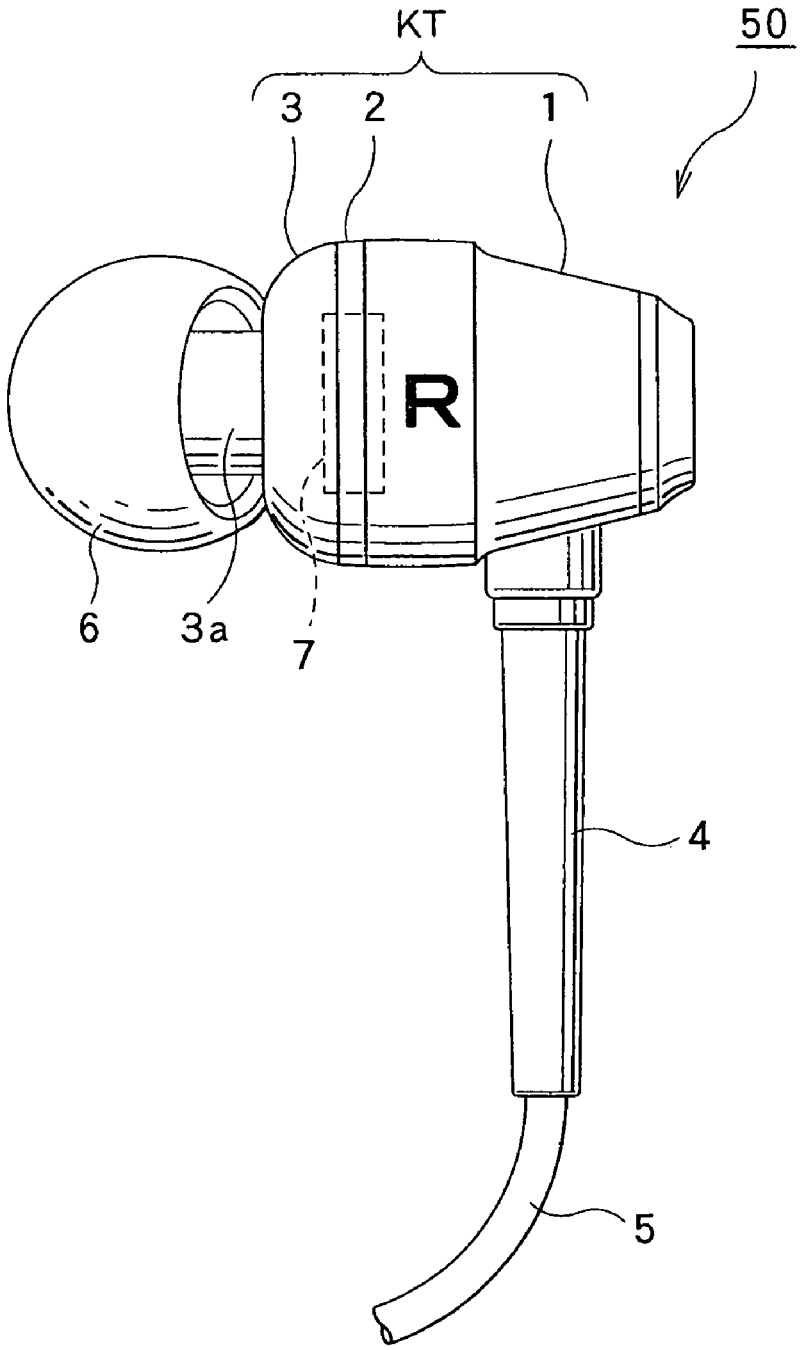
FIG. 1 is a plan view of an embodiment of a headphone according to the present invention.

Shown in FIG. 1 is a plan view of a headphone 50, an embodiment of the present invention.

The headphone 50 is equipped with: a main housing 1; an ornament ring 2 attached to the main housing 1 at the front side of the main housing 1 (the left side in FIG. 1); a front housing 3 attached to the main housing 1 with the ornament ring 2 interposed therebetween; a bushing 4 extending outwardly from the main housing 1; and a cord 5 running from the main housing 1 through the bushing 4.

The main housing 1, the ornament ring 2, and the front housing 3 are combined with one another to constitute a main body KT.

Installed in the main body KT is a speaker unit 7, indicated by a broken line, that converts audio signals externally supplied through the cord 5 from, for example, a portable music player (not shown), into sounds and gives off the sounds.

The front housing 3 is provided with a sound-emitting portion 3*a* formed so as to protrude to the front side of the main housing 1, with an ear piece 6 detachably attached to the tip of the sound-emitting portion 3*a*.

The main housing 1 is formed by cutting wood into a specific shape. The ornament ring 2 is formed by cutting aluminum into a ring. The front housing 3 is formed by resin injection molding. The bushing 4 is formed with a rubber or resin material at the tip side thereof. The material is not limited to above. For example, the main housing 1 may be formed by resin injection molding.

The headphone 50 is attached to the antihelix of a user's ear, with the sound-emitting portion 3*a* and the ear piece 6 inserted into the ear channel, categorized as a so-called canal type.

The headphone 50 in the embodiment is attached to the antihelix of the right ear, as shown in FIG. 1. It may, however, be attached to the antihelix of the left ear. Or, a pair of headphones 50 may be prepared for the left and right ears. Moreover, the headphone 50 may not be a canal type.

Figure 2:
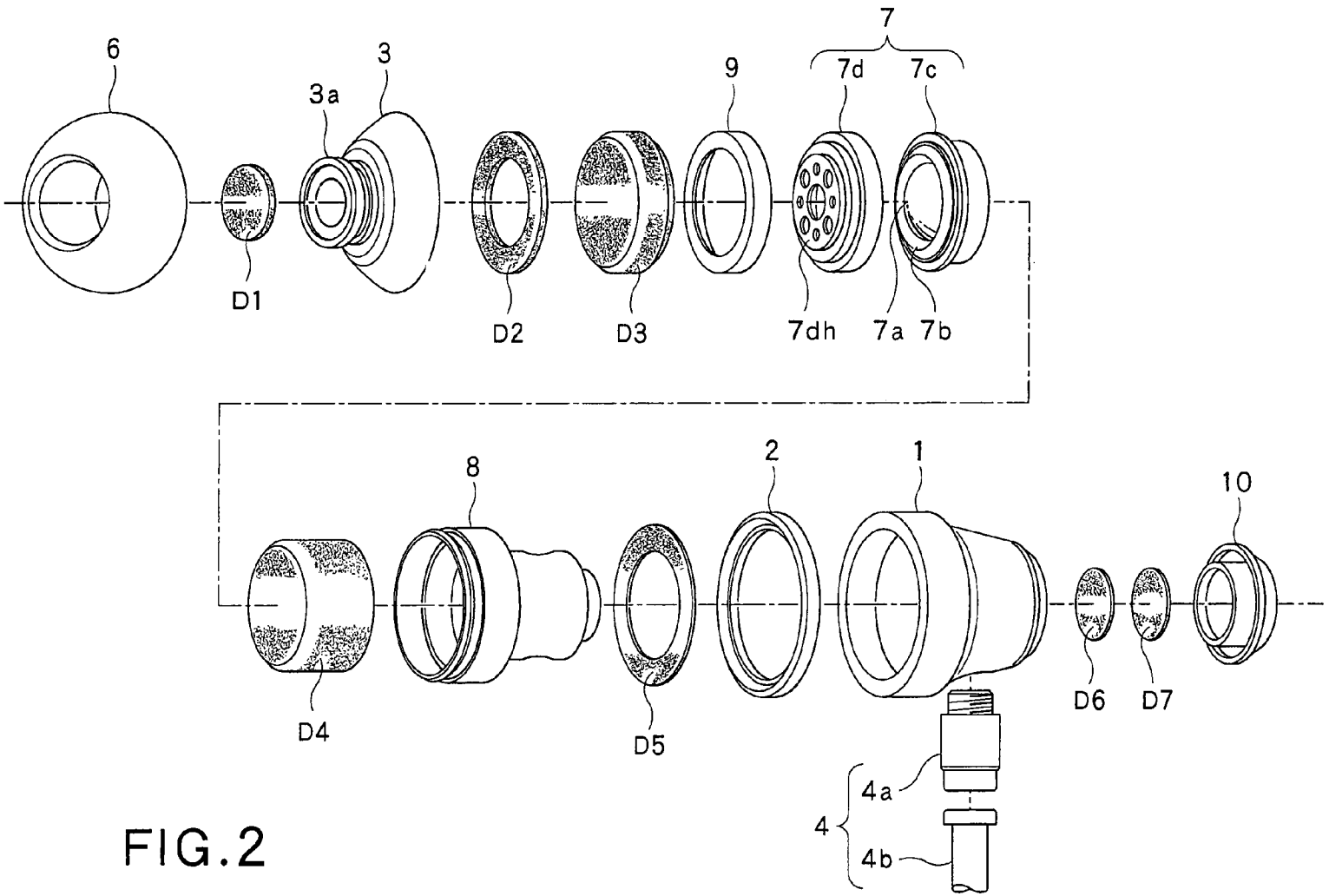
FIG. 2 is an exploded view of the embodiment of the headphone according to the present invention.

FIG. 2 shows an exploded view of the headphone 50.

As shown in FIG. 2, the headphone 50 is equipped with dumpers D1 to D7 for sound-quality adjustments, each made of a material, such as, glass wool or nonwoven fabric.

Attached to the main housing 1 at the rear end (the right side in FIG. 2) is a back ornament 10 provided with an opening (not shown) for sound-quality adjustments, which is communicated with a space BC (FIG. 6) that is a back cavity of the speaker unit 7.

The bushing 4 is constituted by a sleeve 4*a* attached to the main housing 1 and a rubber bush 4*b* connected to the sleeve 4*a*.

The speaker unit 7 is constituted by a unit main body 7*c* having a diaphragm 7*a* and an edge 7*b* attached therearound, and a unit cover 7*d* attached to the front side of the unit main body 7*c*.

Provided between the main housing 1 and the speaker unit 7 is a weight case 8 (a first weighting member) that is a tube-like member made of a material having a higher specific gravity than that of the main housing 1. When the main housing 1 is made of a resin material or wood, brass is cut into a tube-like member to be the weight case 8.

Provided between the front housing 3 and the speaker unit 7 is a weight ring 9 (a second weight member) that is an annular member made of a material having a higher specific gravity than those of the main housing 1 and the front housing 3. When the main housing 1 and the front housing 3 are made of a resin material or wood, brass is cut into an annular member to be the weight ring 9.

The dumber D4 and the speaker unit 7 are inserted into the weight case 8 and then the weight ring 9 is fit into the weight case 8, which will be described later in detail.

Figure 3:
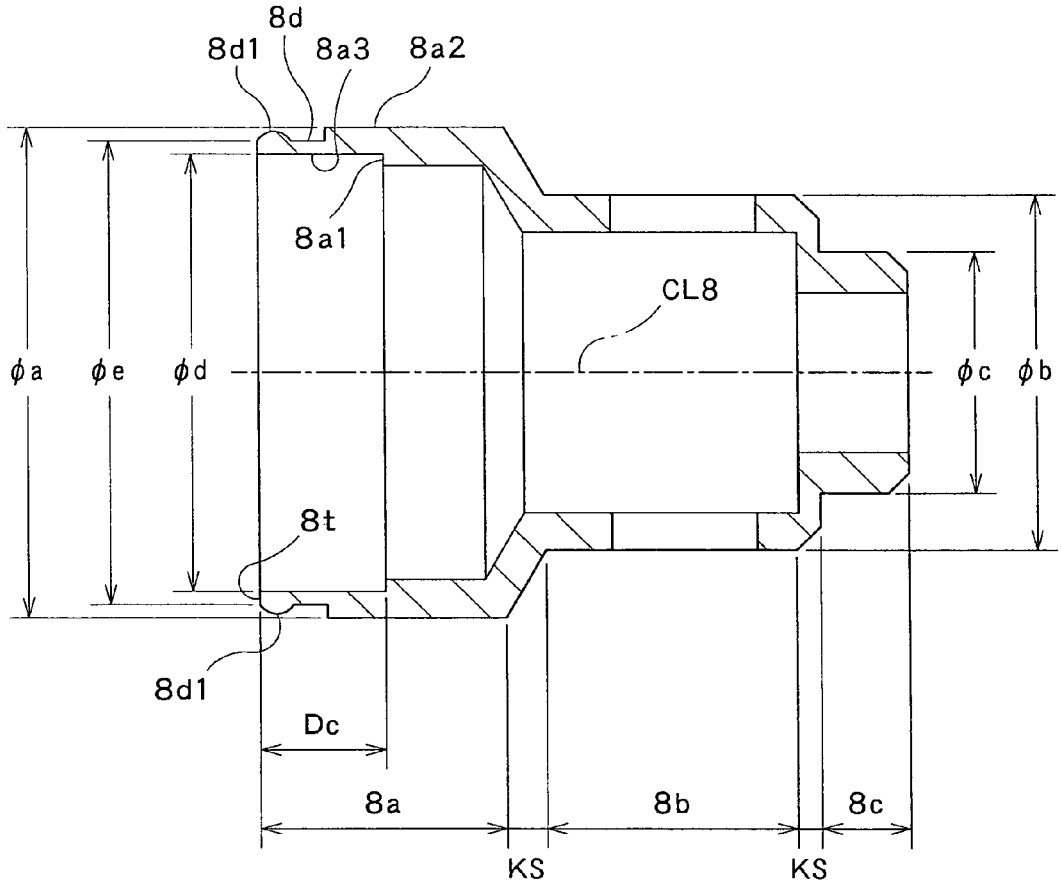
FIG. 3 is a sectional view of a weight case to be used in the embodiment of the headphone according to the present invention.

FIG. 3 is a sectional view illustrating the weight case 8.

The weight case 8 is formed with a large-diameter section 8*a*, an intermediate-diameter section 8*b*, and a small-diameter section 8*c* with outer diameters Øa, Øb, and Øc, respectively, becoming smaller in three stages from the left to the right sides in FIG. 3. Sounds are given off from the right to the left sides in the headphone 50 in FIG. 3.

The large- and intermediate-diameter sections 8*a* and 8*b* are connected to each other, and also the intermediate- and small-diameter sections 8*b* and 8*c* are connected to each other, via oblique sections ks so that the weight case 8 has an outer shape that varies in outer diameter in three stages.

Formed inside the large-diameter section 8*a* is a stepped portion 8*a*1 with a smaller diameter in the right side of FIG. 3. An inner surface 8*a*3 of the large-diameter section 8*a* has an inner diameter Ød at the outside (the left side in FIG. 3) of the stepped portion 8*a*1. Formed at an outer surface 8*a*2 of the large-diameter section 8*a* is a circumferential concave portion 8*d* having a diameter Øe smaller by a specific value than the outer diameter Øa of the large-diameter section 8*a*.

Figure 4:
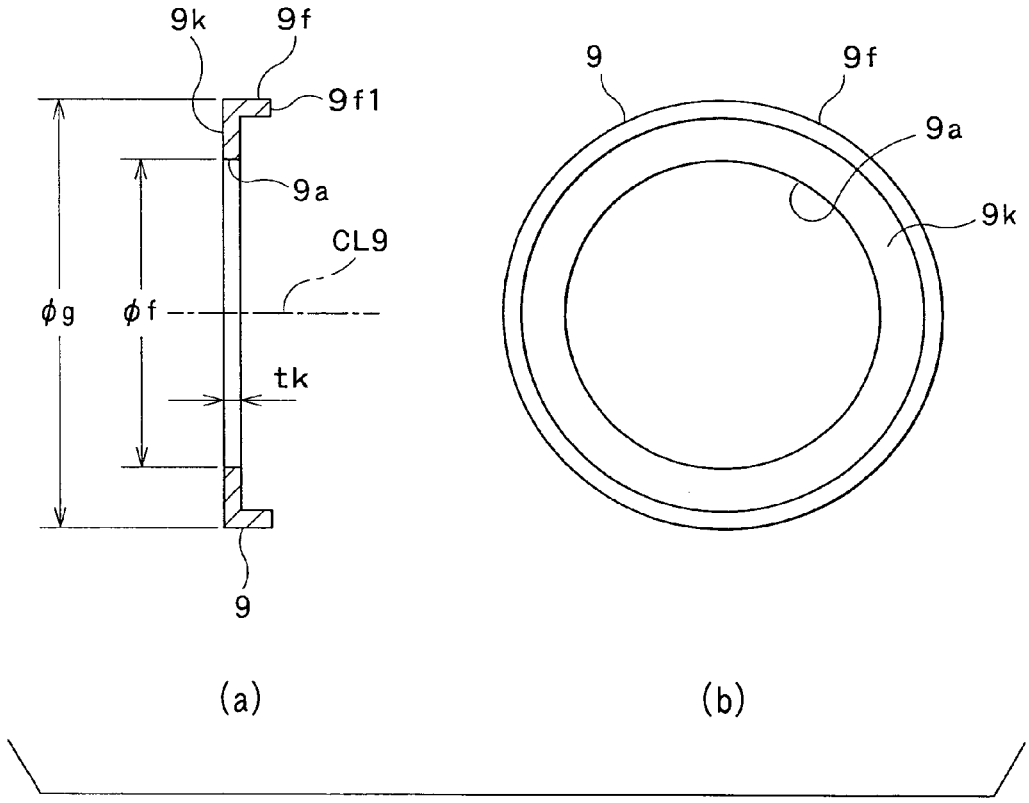
FIG. 4 is a two-view drawing with a sectional view (a) and a plan view (b) of a weight ring to be used in the embodiment of the headphone according to the present invention.

FIG. 4 is a two-view drawing with a sectional view (a) and a plan view (b), that illustrates the weight ring 9.

The weight ring 9 is constituted by an annular base 9*k* having an outer diameter Øg. The weight ring 9 is provided with a center opening 9*a* having an inner diameter Øf and a flange portion 9*f* that erects along an axis CL9 at the circumference of the base 9*k*.

Figure 5:
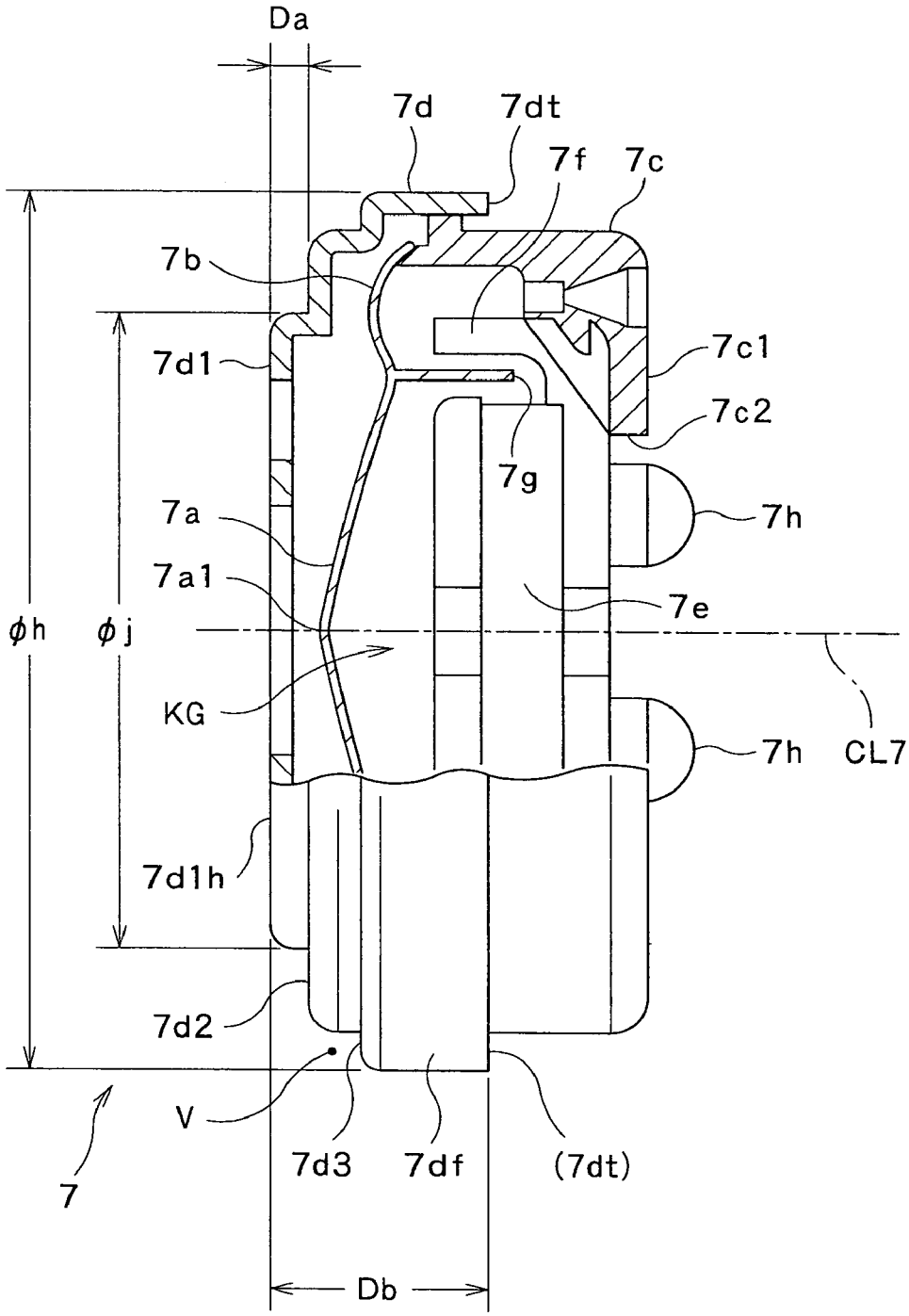
FIG. 5 is a partial sectional view of a speaker unit to be used in the embodiment of the headphone according to the present invention.

FIG. 5 is a partial sectional view (with a partial exterior view) illustrating the speaker unit 7.

The unit main body 7*c* of the speaker unit 7 is formed into roughly a pan shape having a bottom portion 7*c*1 with an opening 7*c*2 through which terminals 7*h* are exposed. The unit main body 7*c* supports a magnetic circuit that is a driving source KG and constituted by a magnet 7*e* and a yoke 7*f*. Moreover, the unit main body 7*c* supports the diaphragm 7*a* via a circumferential edge 7*b*. Fixed to the one side of the diaphragm 7*a* is a cylindrical bois coil bobbin 7*g* with an axis CL7.

The diaphragm 7*a* is formed into a flat cone shape with a summit portion 7*a*1, the highest point, at the center. Instead of the flat cone shape, the diaphragm 7*a* may be formed into a shape of moderate curvature, such as a portion of a spherical surface. The diaphragm 7*a* vibrates or moves back and forth along the axis CL7 (a driving axis) by a drive power of the bois coil bobbin 7*g* given by the magnetic circuit (the power source KG) based on audio signals supplied through the cord 5 (FIG. 1) from a portable music player (not shown), for example.

The unit cover 7*d* of the speaker unit 7 is formed into a flat cone shape with a bottom portion 7*d*1 having a plurality of sound-emitting holes 7*dh* (FIG. 2) through which sounds output by the speaker unit 7 are given off outside. The sound-emitting holes 7*dh* are provided over an outer surface 7*d*1*h* of the bottom portion 7*d*1, that is a sound-emitting surface.

Two stepped portions 7*d*2 and 7*d*3 are provided in relation to the bottom portion 7*d*1 of the unit cover 7*d*. The stepped portion 7*d*2 closer to the bottom portion 7*d*1 is provided in a zone roughly corresponding to the edge 7*b* so that the stepped portion 7*d*2 does not interfere with the diaphragm 7*a* when the diaphragm 7*a* protrudes towards the bottom portion 7*d*1. The weight ring 9 can be fit into the annular space provided by the stepped portion 7*d*2, as described later.

A flange portion 7*df* is provided at the opening 7*c*2 side (the right side in FIG. 5) of the stepped portion 7*d*3, with an outer diameter Øh. The outer diameter Øh is the largest outer diameter in the speaker unit 7 but roughly equal to or little bit smaller than the inner diameter Ød of the inner surface 8*a*3 of the weight case 8 shown in FIG. 3.

The bottom portion 7*d*1 has an outer diameter Øj that is little bit smaller than the inner diameter Øf the weight ring 9 shown in FIG. 4.

A distance Da between the bottom portion 7*d*1 and the stepped portion 7*d*2 along the axis CL7 is roughly equal to a thickness tk of the base 9*k* of the weight ring 9 shown in the sectional view of FIG. 4.

A distance Db from the bottom portion 7*d*1 to an opening end 7*dt* of the unit cover 7*d* along the axis CL7 is roughly equal to a distance Dc from an opening end 8*t* of the large-diameter section 8*a* to the stepped portion 8*a*1 along an axis CL8 in the weight ring 8 shown in FIG. 3.

Figure 6:
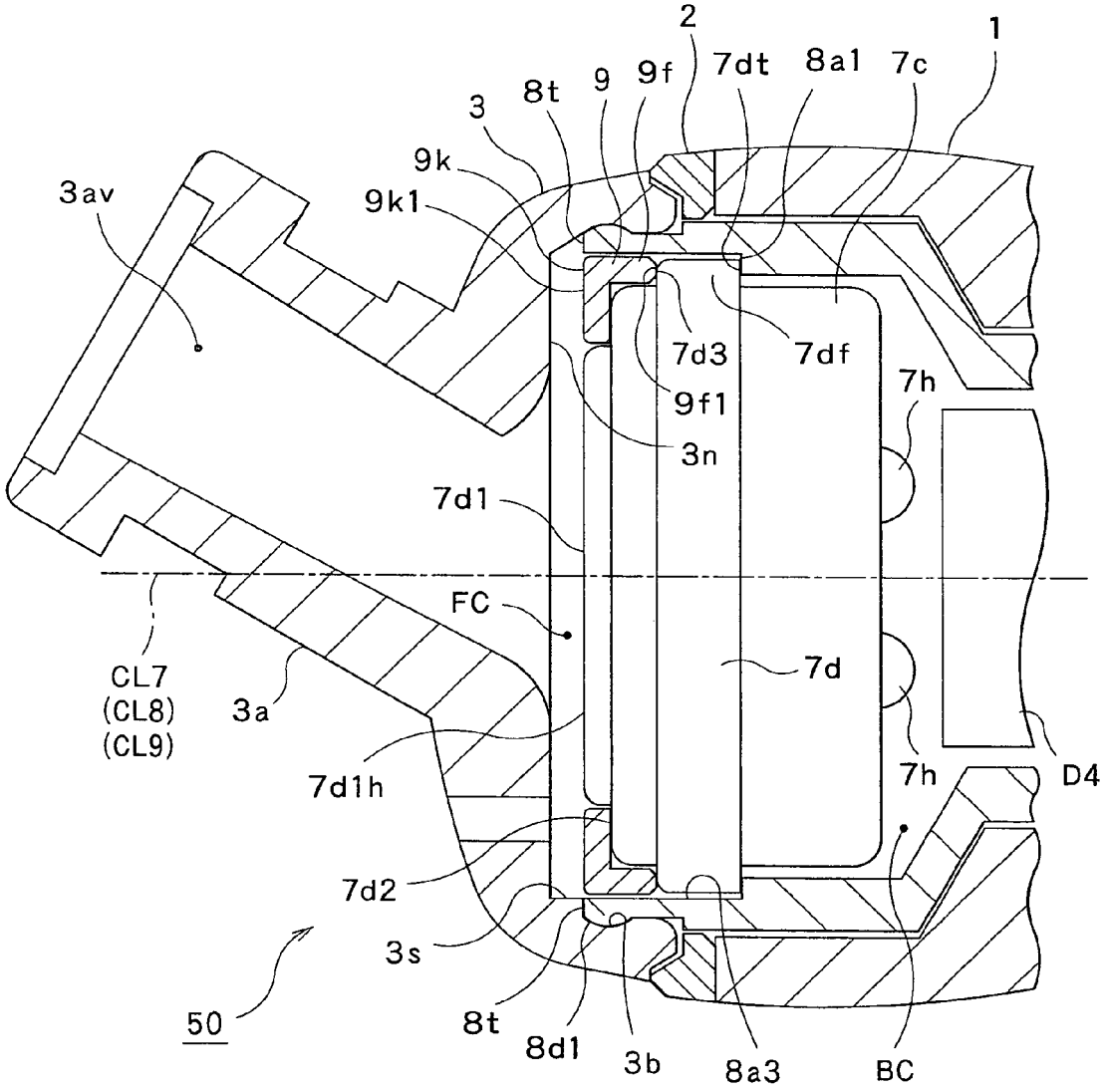
FIG. 6 is a partial sectional view of the embodiment of the headphone according to the present invention, after assembled.

FIG. 6 is a partial sectional view of the headphone 50 after assembled.

The headphone 50 is assembled so that the axes CL7, CL8 and CL9 (in FIGS. 5, 3 and 4, respectively) meet one another to constitute one axis.

Explained below is the assembly mainly for the weight case 8, the weight ring 9, and the speaker unit 7.

Firstly, as a sound absorber, the dumper D4 is inserted into the large-diameter section 8*a* (FIG. 3) of the weight case 8. The speaker unit 7 is then inserted into the large-diameter section 8*a* from the unit main body 7*c* (FIG. 5).

The weight case 8 is formed with the stepped portion 8*a*1 for the speaker unit 7 so that, in FIGS. 3 and 6, the unit main body 7*c* can be inserted into the weight case 8 up to the right side of the stepped portion 8*a*1 whereas the unit cover 7*d* cannot be inserted up to the right side of the stepped portion 8*a*1. When the speaker unit 7 is inserted, the opening end 7*dt* of the unit cover 7*d* is in contact with the stepped portion 8*a*1 so that the position of the speaker unit 7 along the axis CL8 (FIG. 3) can be decided.

Moreover, the speaker unit 7 is inserted into the weight case 8 with a very small gap between the outer circumferential surface (a first face) of the flange portion 7*df* (FIG. 5) of the speaker unit 7 and the inner surface 8*a*3 (FIG. 3) of the large-diameter section 8*a* of the weight case 8. An adhesive is filled in the gap to fix the speaker unit 7 to the weight case 8. When the speaker unit 7 is fixed to the weight case 8, the outer surface 7*d*1*h* of the bottom portion 7*d*1 (FIG. 5) of the speaker unit 7 and the opening end 8*t* (FIG. 3) of the weight ring 8 are located at the same position along the axis CL8 (CL7) shown in FIG. 3 (FIG. 5).

Then, the weight ring 9 is attached so that the flange portion 9*f* (FIG. 4) is fit into an annular gap V (FIG. 5) formed between the inner surface 8*a*3 (FIG. 3) of the weight case 8 and the stepped portion 7*d*3 (FIG. 5) of the unit cover 7*d* of the speaker unit 7.

In FIG. 6, when the weight ring 9 is attached, a top surface 9*f*1 of the flange portion 9*f* is in contact with the stepped portion 7*d*3 (a second face) of the unit cover 7*d*. Moreover, when the weight ring 9 is attached in FIG. 6, a surface 9*k*1 of the annular base 9*k*, that is the opposite of the top surface 9*f*1 of the flange portion 9*f*, is located in the same position as the bottom portion 7*d*1 of the unit cover 7*d* and the opening end 8*t* of the weight case 8, along the axis CL9.

The weight ring 9, the unit cover 7*d*, and the weight case 8 are fixed to one another with an adhesive which is filled, at least, between: the top surface 9*f*1 of the flange portion 9*f* (of the weight ring 9) and the stepped portion 7*d*3 of the unit cover 7*d* (of the speaker unit 7); the base 9*k* of the weight ring 9 and the stepped portion 7*d*2 of the unit cover 7*d*; and the base 9*k* and the outer circumferential surface of the flange portion 9*f*, and the inner surface 8*a*3 of the weight case 8.

After the weight ring 9 is fixed, the front housing 3 is attached to the weight case 8 so that the ornament ring 2 is supported between the front housing 3 and the main housing 1.

Formed at the tip of the circumferential concave portion 8*d* of the weight case 8 is an engaging portion 8*d*1 that protrudes a little bit along the axis CL8, the left side in FIG. 3. Also formed on the inner surface of the open end of the front housing 3 is a concave portion 3*b*, as shown in FIG. 6.

The engaging portion 8*d*1 is engaged with the concave portion 3*b*. The front housing 3 is then fixed to the weight case 8 and the ornament ring 2 with an adhesive, to be united with the main housing 1.

When the front housing 3 is fixed, a flat disc-like space FC is created as a front cavity between the front surface of the speaker unit 7 and internal front and side surfaces 3*n* and 3*s* of the front housing 3, as shown in FIG. 6. The space FC is communicated with an internal cylindrical space 3*a*V of the sound-emitting portion 3*a*.

The headphone 50 is assembled through the procedures described above.

As described above, the speaker unit 7 is supported by the main housing 1 via the weight case 8 and the weight ring 9. Thus, the speaker unit 7 is not in contact with the main housing 1 and the front housing 3.

When the weight case 8 and the weight ring 9 are fixed to each other, at least either one is fixed to the main housing 1 or the front housing 3. Not only that, the weight case 8 and the weight ring 9 may not be fixed to each other but separated from each other. In this case, each is fixed to the main housing 1 or the front housing 3.

In the headphone 50 of this embodiment, the speaker unit 7 is fixed such that the opening end 7*dt* at the rear side is in contact with the stepped portion 8*a*1 of the weight case 8. This structure allows the weight case 8 that has a higher specific gravity than the main housing 1, to receive the reaction of the diaphragm 7*a* to the rear side when the diaphragm 7*a* moves forward (the left side in FIG. 5), for higher audio-signal conversion efficiency and sound quality.

Moreover, the speaker unit 7 is fixed such that the weight ring 9 fixed to the weight case 8 to be united is in contact with the two stepped portions 7*d*2 and 7*d*3 of the unit cover 7*d* that protrude at least in the front side. This structure allows the weight case 8 that has a higher specific gravity than the main housing 1, to receive the reaction of the diaphragm 7*a* to the front side when the diaphragm 7*a* moves backward (the right side in FIG. 5), for much higher audio-signal conversion efficiency and sound quality.

The weight case 8 and the weight ring 9 may be separated from each other, as described above. However, the united structure of the weight case 8 and the weight ring 9 gives higher audio-signal conversion efficiency and sound quality than the separated structure.

Moreover, the surface 9*k*1 of the annular base 9*k* of the weight ring 9 is located at the same position as the outer surface 7*d*1*h* (FIG. 5) of the bottom portion 7*d*1 of the unit cover 7*d* and the opening end 8*t* of the weight case 8, along the axis CL9 as shown in FIG. 6. In other words, the opening ends of the weight ring 9, the unit cover 7*d*, and the weight case 8 are located in the same plane in the sound-emitting side. The plane is perpendicular to the axes CL7, CL8 and CL9. However, the opening ends of the weight ring 9 and the unit cover 7*d* may, at least, be located in the same plane in the sound-emitting side.

The above structure gives an almost flat (or a less uneven) space FC (the front cavity), which allows almost no reflection of output sounds given off through the outer surface 7*d*1*h* (the sound-emitting surface) shown in FIGS. 5 and 6, thus offering clearer sounds to users.

Moreover, the unit cover 7*d* is located as closer to the sound-emitting portion 3*a* as much as possible but not protruding into the space FC. This arrangement allows the diaphragm 7*a* of the speaker unit 7 to be closer to the user's ear without creating an uneven space FC, thus achieving a higher sound pressure level in sound recognition.

It is further understood by those skilled in the art that the foregoing description is a preferred embodiment of the disclosed device and that various changes and modifications may be made in the invention without departing from the spirit and scope thereof.

For example, the weight case 8 may not be made of brass but any material having a specific gravity higher than that of the main housing 1. Moreover, the weight ring 9 may not be made of brass but any material having a specific gravity higher than those of the main housing 1 and the front housing 3.

Moreover, the headphone 50 in this embodiment is a canal type. However, the present invention can be applied to an inner-ear type, an overhead type equipped with a headband, etc.

Furthermore, the headphone 50 in this embodiment can be connected to a portable music player. Not only that, the present invention can be applied to hearing aids, sound collectors, transceivers, head sets, etc.

Still furthermore, the main body KT may be constituted by the main housing 1 and the front housing 3, without the ornament ring 2 being provided.

As disclosed above in detail, the present invention achieves higher audio-signal conversion efficiency and sound quality for headphones, irrespective of the movement of the diaphragm to the front and rear sides.

What is claimed is:

1. A headphone for converting an audio signal into a sound and outputting the sound comprising:

a speaker unit including a diaphragm and a driving source that vibrates the diaphragm along a driving axis that passes through the speaker unit, the speaker unit having a first face and an opposing second face along the driving axis, the diaphragm and the driving source being installed in the speaker unit between the first and second faces;

a first weighting member fixed as being in contact with the first face of the speaker unit;

a second weighting member fixed as being in contact with the second face of the speaker unit; and a housing that installs the speaker unit and the first and second weighting members, wherein at least either the first or the second weighting member is fixed to the housing, the speaker unit is installed in the housing via the first and second weighting members so that the speaker unit is not in direct contact with the housing, and the first and second weighting members have a higher specific gravity than the housing.

2. The headphone according to claim 1, wherein the second face of the speaker unit, with which the second weighting member is in contact, is located in a direction in which the sound is given off from the speaker unit.

3. The headphone according to claim 2, wherein the second weighting member is installed in the first weighting member.

4. The headphone according to claim 2, wherein the second face of the speaker unit and an end of the second weighting member in the direction in which the sound is given off are located in a same plane that is perpendicular to the drive axis.

5. The headphone according to claim 4, wherein the second face of the speaker unit and an end of the first weighting member in the direction in which the sound is given off are located in the same plane.

6. The headphone according to claim 1, wherein the first and second weighting members are fixed to each other.

7. The headphone according to claim 1, wherein the first and second weighting members are separated from each other and each of the first and second weighting members is fixed to the housing.

* * * * *